US010342357B2

(12) United States Patent
Backus, III

(10) Patent No.: US 10,342,357 B2
(45) Date of Patent: Jul. 9, 2019

(54) BED FRAME WALL PROTECTOR

(71) Applicant: Glenn Anthony Backus, III, Richfield, MN (US)

(72) Inventor: Glenn Anthony Backus, III, Richfield, MN (US)

( * ) Notice: Subject to any disclaimer, the term of this patent is extended or adjusted under 35 U.S.C. 154(b) by 19 days.

(21) Appl. No.: 15/431,342

(22) Filed: Feb. 13, 2017

(65) Prior Publication Data

US 2017/0231399 A1 Aug. 17, 2017

Related U.S. Application Data

(60) Provisional application No. 62/389,068, filed on Feb. 17, 2016.

(51) Int. Cl.

| | |
|---|---|
| ***A47C 19/02*** | (2006.01) |
| ***A47C 19/00*** | (2006.01) |
| ***A47C 21/00*** | (2006.01) |
| ***A47C 31/00*** | (2006.01) |

(52) U.S. Cl.

CPC ..... *A47C 19/02* (2013.01); *A47C 19/00* (2013.01); *A47C 21/00* (2013.01)

(58) Field of Classification Search

CPC ..... A47C 19/02; A47C 19/021; A47C 21/06; A47C 31/00; A47C 19/00; A47C 21/00; A47B 95/043

See application file for complete search history.

(56) References Cited

U.S. PATENT DOCUMENTS

| | | | | |
|---|---|---|---|---|
| 3,144,236 | A * | 8/1964 | Clanin | A47B 95/043 150/154 |
| 4,323,610 | A * | 4/1982 | Leverich | A47B 95/043 428/100 |
| 5,065,972 | A * | 11/1991 | Buckshaw | A47B 95/043 206/586 |
| 5,322,257 | A * | 6/1994 | Verderose | A47B 91/00 248/205.3 |
| 5,508,078 | A * | 4/1996 | Stalnaker | A47B 95/043 248/345.1 |
| 5,603,140 | A * | 2/1997 | Pryce | A47B 91/00 16/18 CG |
| 5,613,253 | A * | 3/1997 | Rose | A47C 19/005 5/309 |
| 5,624,724 | A * | 4/1997 | Relly | E06B 1/6069 428/167 |
| 6,260,237 | B1 * | 7/2001 | McCue | E01F 15/0469 16/404 |
| 6,826,790 | B1 * | 12/2004 | Polevoy | A47C 19/024 248/345.1 |
| 7,310,916 | B2 * | 12/2007 | Gorman | E06B 1/6069 52/126.1 |
| 7,311,958 | B2 * | 12/2007 | Morris | A47B 95/043 108/90 |

(Continued)

*Primary Examiner* — Robert G Santos
*Assistant Examiner* — Rahib T Zaman
(74) *Attorney, Agent, or Firm* — Vidas Arrett & Steinkraus P.A.

(57) ABSTRACT

A bed frame wall protector kit having a pair of headboard bracket sleeves, each having a slot sized to receive a headboard bracket and where the pair of headboard bracket sleeves protect a wall from the headboard brackets. The sleeves can also include double-sided tape to allow for attachment to a headboard, once a headboard is attached to the headboard brackets.

16 Claims, 2 Drawing Sheets

(56) References Cited

U.S. PATENT DOCUMENTS

| | | | | |
|---|---|---|---|---|
| 7,587,790 | B2 * | 9/2009 | McCue | E01F 15/0469 16/404 |
| 8,028,362 | B1 * | 10/2011 | Barreau | A47C 21/00 248/345.1 |
| 9,060,615 | B1 * | 6/2015 | Jaeger-Wayboer | F16M 13/022 |
| 2009/0256037 | A1 * | 10/2009 | Singh | A47C 19/022 248/205.6 |
| 2013/0019410 | A1 * | 1/2013 | Willis | A47C 31/00 5/663 |
| 2014/0338125 | A1 * | 11/2014 | Polevoy | A47C 19/005 5/400 |

* cited by examiner

BED FRAME WALL PROTECTOR

CROSS-REFERENCE TO RELATED APPLICATIONS

This application claims priority to provisional patent application no. Not Applicable 62/389,068 filed Feb. 17, 2016, the entire contents of which are hereby incorporated by reference.

STATEMENT REGARDING FEDERALLY SPONSORED RESEARCH

Not Applicable

FIELD OF THE INVENTION

This invention relates to wall protection, and more specifically to a pair of sleeves which fit onto the headboard brackets of a bed frame to protect the wall from damage, and which can also be placed onto the back of a headboard (when added to the bedframe).

BACKGROUND OF THE INVENTION

Bed frames bump against the wall from getting into and out of bed, or making the bed, and can cause scuffs and scratches (or worse). What is needed is a device for protecting the wall from damage from the bed frame hitting the wall.

BRIEF SUMMARY OF THE INVENTION

The invention solves this problem with a bed frame wall protector kit having a pair of headboard bracket sleeves, each having a slot sized to receive a headboard bracket and where the pair of headboard bracket sleeves protect a wall from the headboard brackets.

The inventive headboard bracket sleeves can be sold as a kit or with the purchase of a bed frame.

An additional embodiment includes double sided tape adhered to the on the non-wall side of the headboard bracket sleeves so that once a headboard is attached to the headboard brackets, the cover layer may be peeled off the double sided tape and the sleeves adhesively attached to the wall side of the headboard to continue to protect the wall.

DETAILED DESCRIPTION OF THE INVENTION

Figure 1:
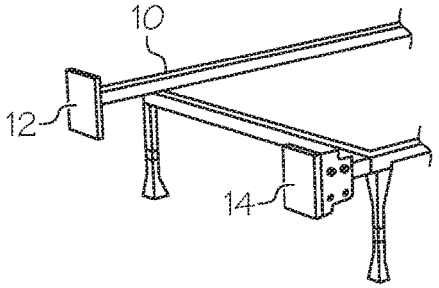
FIG. 1 is a schematic view showing a bed frame with the headboard bracket sleeves installed.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 3:
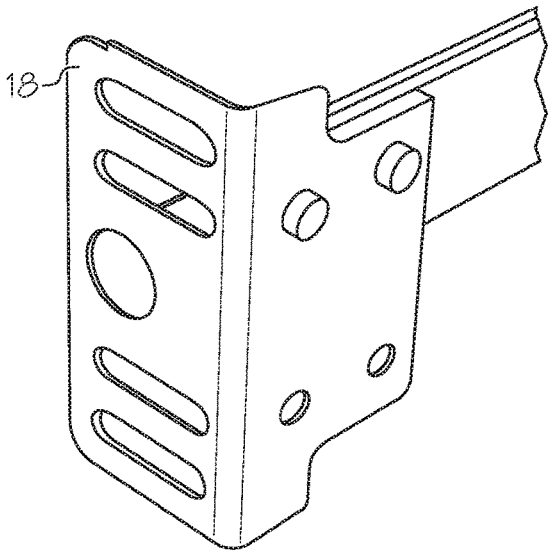
FIG. 3 is a view of a standard headboard bracket.

FIG. 1 shows a bedframe 10 with headboard brackets 12 and 14 slid onto headboard brackets (shown as 18 in FIG. 3).

Figure 2:
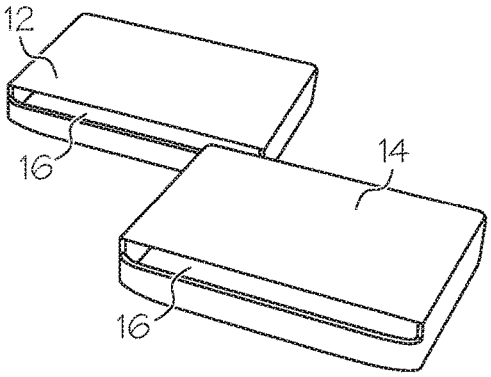
FIG. 2 shows a pair of headboard bracket sleeves with a slot for attaching onto the brackets.

FIG. 2 shows a pair of headboard bracket sleeves 12 and 14, each with a slot sized to fit over a standard headboard bracket. It should be understood that the sleeve and slot can be sized to fit any commercially available headboard bracket. It should also be understood that the sleeves may be sized to just cover the bracket 18 or may extend several inches above and/or below the bracket, if desired.

The sleeves may be made of natural rubber, synthetic rubber, foam rubber, EPDM (Ethylene Propylene Diene Monomer) closed cell sponge rubber, and spongy foamed neoprene rubber. Any non-marking elastomeric material which can be easily injection molded, extruded or stamped out of a roll of material could be utilized.

It should be understood that the sleeves 12 and 14 could be one-piece or molded in two halves (20 and 22), with the slot formed in the mold, the two halves connected together by adhesive, or other fastening techniques known to those skilled in the art. In a one-piece construction the slot could be formed mechanically, by cutting or by melting the slot into the sleeve, as is well known in the art.

Figure 6:
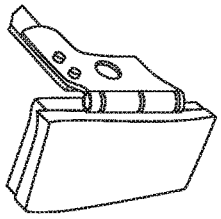
FIG. 6 shows the wall side of the alternative embodiment fully slid onto the bracket.
Figure 5:
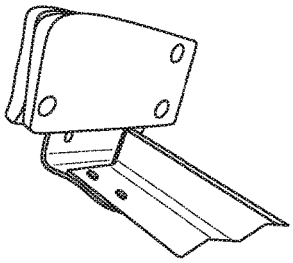
FIG. 5 is a view of the alternative embodiment fully slid onto the bracket.
Figure 4:
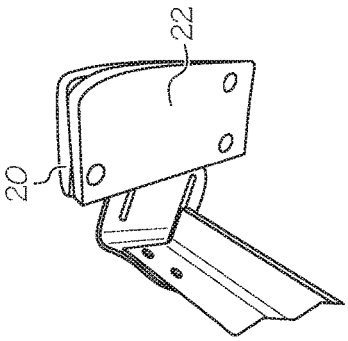
FIG. 4 is a view of an alternative embodiment where each sleeve is made of two parts attached to each other, partially slid onto the bracket.

FIGS. 4-6 show a two piece sleeve construction being slid onto a bracket 18.

Figure 7:
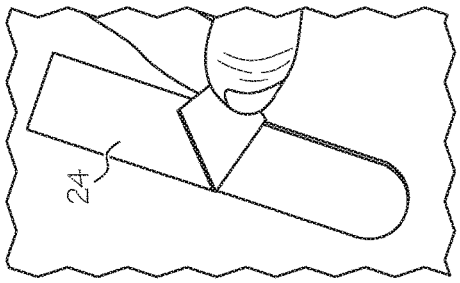
FIG. 7 shows an example of the double sided tape which would be attached to the non-wall side of the sleeve, showing the cover layer partially peeled, so the sleeve may be attached to the headboard.

FIG. 7 shows an exemplary piece of double-sided adhesive tape 24, which could also be placed on the non-wall side of the sleeves 12 and 14. The tape could be one piece, multiple pieces or could be one piece sized to fit the entire side of the sleeve (if desired). Any commercially available double-sided tape could be utilized.

Figure 8:
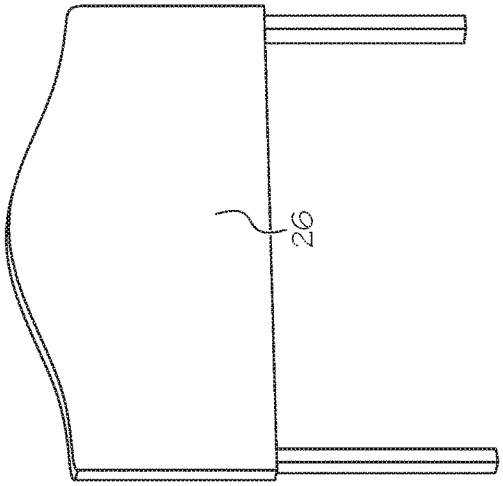
FIG. 8 shows a standard headboard, on which the sleeves would be adhesively attached to the wall side after the headboard is attached to the headboard brackets.

FIG. 8 shows a standard headboard 26, which would be attached to the headboard brackets 18. In order to attach the headboard 26, the sleeves 12 and 14 would be removed from the brackets, but could still function to protect the wall by peeling the cover sheet off the tape 24 and attaching the sleeves 12 and 14 to the wall side of the headboard 26.

What is claimed is:

1. A bed frame wall protector kit comprising:

a pair of headboard bracket sleeves, each having a preformed slot sized to receive a headboard bracket, the slot being constructed and arranged to receive and surround a headboard bracket, whereby the pair of headboard bracket sleeves protect a wall from the headboard brackets.

2. The bed frame wall protector kit of claim 1 wherein the headboard bracket sleeves are made from material selected from the group consisting of natural rubber, synthetic rubber, foam rubber, EPDM (Ethylene Propylene Diene Monomer) closed cell sponge rubber, and spongy foamed neoprene rubber.

3. The bed frame wall protector kit of claim 2 wherein the material is non-marking.

4. The bed frame wall protector kit of claim 2 wherein the headboard bracket sleeves are made using iniection molding.

5. The bed frame wall protector kit of claim 2 wherein the headboard bracket sleeves are each made from first and second injection molded halves which are connected together.

6. The bed frame wall protector kit of claim 2 wherein the headboard bracket sleeves are made by stamping them out.

7. The bed frame wall protector kit of claim 2 wherein the headboard bracket sleeves are made by extrusion.

8. The bed frame wall protector kit of claim 1 wherein the headboard bracket sleeves have a bracket side and a wall side, and wherein the bracket side has double-sided adhesive tape adhered to it, with un-adhered side of the double-sided adhesive tape having a cover sheet, whereby when a headboard is attached to a bedframe, the headboard bracket sleeves may be removed from the headboard brackets, the cover sheets removed and the headboard bracket sleeves may be adhered to the wall side of the headboard to protect the wall from the headboard.

9. In combination a bed frame and a bed frame wall protector kit, the bed frame having a pair of headboard brackets and the bed frame wall protector kit having a pair of headboard bracket sleeves, the sleeves each having a preformed slot sized to receive a headboard bracket, the slot being constructed and arranged to receive and surround a headboard bracket, whereby the pair of headboard bracket sleeves protect a wall from the headboard brackets.

10. The bed frame wall protector kit of claim 9 wherein the headboard bracket sleeves are made from material selected from the group consisting of natural rubber, synthetic rubber, foam rubber, EPDM (Ethylene Propylene Diene Monomer) closed cell sponge rubber, and spongy foamed neoprene rubber.

11. The bed frame wall protector kit of claim 10 wherein the material is non-marking.

12. The bed frame wall protector kit of claim 10 wherein the headboard bracket sleeves are made using injection molding.

13. The bed frame wall protector kit of claim 12 wherein the headboard bracket sleeves are each made from first and second injection molded halves which are connected together.

14. The bed frame wall protector kit of claim 10 wherein the headboard bracket sleeves are made by stamping them out.

15. The bed frame wall protector kit of claim 10 wherein the headboard bracket sleeves are made by extrusion.

16. The bed frame wall protector kit of claim 9 wherein the headboard bracket sleeves have a bracket side and a wall side, and wherein the bracket side has double-sided adhesive tape adhered to it, with un-adhered side of the double-sided adhesive tape having a cover sheet, whereby when a headboard is attached to the bedframe, the headboard bracket sleeves may be removed from the headboard brackets, the cover sheets removed and the headboard bracket sleeves may be adhered to the wall side of the headboard to protect the wall from the headboard.

* * * * *